United States Patent [19]

Miller et al.

[11] Patent Number: 4,629,163

[45] Date of Patent: Dec. 16, 1986

[54] JACK FOR CYLINDRICAL TANK

[75] Inventors: Timothy L. Miller, Holmesville; Richard J. Ehmke, Blue Springs, both of Nebr.

[73] Assignee: Dempster Industries, Inc., Beatrice, Nebr.

[21] Appl. No.: 715,456

[22] Filed: Mar. 25, 1985

[51] Int. Cl.[4] ..... B66F 3/00

[52] U.S. Cl. ..... 254/133 R; 254/101; 254/134; 254/100

[58] Field of Search ..... 254/133 R, 134, 100, 254/101, 103, 35, 89 H, 89 R

[56] References Cited

U.S. PATENT DOCUMENTS

| | | | |
|---|---|---|---|
| 1,709,506 | 4/1929 | Wallace et al. | 254/101 |
| 2,867,410 | 1/1959 | Southerwick | 254/133 R |
| 3,433,447 | 3/1969 | Carroll | 254/89 H |
| 3,850,409 | 11/1974 | Davis et al. | 254/133 R |
| 3,892,385 | 7/1975 | Andrist et al. | 254/133 R |

*Primary Examiner*—Frederick R. Schmidt
*Assistant Examiner*—Judy J. Hartman
*Attorney, Agent, or Firm*—Hugh D. Jaeger

[57] ABSTRACT

Jack for elongated cylindrical tanks, such as propane tanks, including a jack housing, a jack actuator tube coming out of the jack housing, and an elongated jack foot at a right angle to the jack actuator tube. The jack channel includes a tank support affixed to the jack channel and opposing chain plates at right angles to the tank support including keyhole slots for holding chain links. Two chains including hooks and chafe protectors secure to feet of a cylindrical tank, and each free end of the chain secures through the key hole slot. A jack handle actuates and extends the elongated jack foot downwardly thereby carrying and raising the tank resting on pads on the tank support, as well as the jack housing upwardly in an opposite direction to the actuation of the elongated jack foot.

1 Claim, 4 Drawing Figures

JACK FOR CYLINDRICAL TANK

BACKGROUND OF THE INVENTION

1. Field of the Invention

The present invention pertains to a jack and, more particularly, pertains to a jack for the raising of propane gas tanks such as those found on the farms, in the countryside, and in industrial areas.

2. Description of the Prior Art

It has always been a particularly hard endeavor to service and paint the bottom of propane gas tanks, particularly the larger elongated propane gas tanks which are used on farms and in the countryside for heating of homes or other buildings. Servicemen have always had to get underneath the tanks to paint the bottoms, inspect the bottoms of the tanks, and just provide routine maintenance with respect to the removal of weeds, brush and trash from underneath the tanks. A wide variety and assortment of articles have been used to attempt to prop or pry the tanks up while someone crawls underneath, which has always been a significant safety hazard. Short of lifting up an entire tank with a propane gas tank truck, which is not only an expensive endeavor because of time and motion, but just because of all the other considerations involved, there has never been a safe, approved, secure method or apparatus for lifting one end of a propane gas tank. The propane gas tanks, which are approximately three feet in diameter and six feet long, although the size of the tank of course varies on the installation, have feet which support a cylinder which is bulky. The handling of propane gas tanks also has certain inherent safety considerations which have to be taken into account so that the tank is neither damaged nor does it fall upon the individual who is servicing the tank.

The present invention overcomes the disadvantages of the prior art and provides a solution to the prior art problem of raising propane gas tanks by providing a jack which operates against one end of the tank and provides for secure gripping of the feet by chains.

SUMMARY OF THE INVENTION

The general purpose of the present invention is a jack for raising one end of a cylindrical tank to a height which provides for service and maintenance of the tank. The tank jack is easy to use and provides safety to the individual utilizing the jack, in that the individual is behind the jack and the tank is actuated upwardly. The jack for the cylindrical tank is constructed of heavy-duty steel providing for safety considerations during the raising of the cylindrical tank.

According to one embodiment of the present invention, there is provided a jack for a cylindrical jack including a jack channel, a jack housing tube, a jack including a crank secured to the jack housing tube, a jack actuator tube, the jack including an elongated jack foot extending downwardly from the jack actuator tube, a triangular support member secured to the jack channel, a pivot pin and pivot tube connecting the jack channel to the jack housing tube, a chain plate including keyhole slots for accommodating chain links secured to an underside of the tank support, support pads secured to the tank support and an upper portion of the jack channel, and two chain assemblies including hooks, clevis pins, and chafe protectors partially over the chain links whereby the chain links secure in through the keyhole slots and the hooks secure to the feet of the cylindrical tank. As the elongated jack foot is cranked out of the jack housing tube, the downward motion of the elongated jack foot and jack actuator tube provides upward movement to the tank support carried about and upwardly on the jack housing tube for lifting the cylindrical tank upwardly and pivoting about the opposing tank feet.

One significant aspect and feature of the present invention is a jack for a cylindrical tank, such as propane tanks, which raises the propane tank upwardly off one end and pivots the tank about the opposing feet on the other end. The tank is raised to a height to provide for service, maintenance, and painting of the underside of the propane tank, as well as for inspection of the underside of the tank.

Another significant aspect and feature of the present invention is a jack for raising of a cylindrical tank which is easy to use and does not require any hand tools whatsoever to place the jack in operation. All that is required is merely the placing of the hooks about the feet of the tank and securing the appropriate chain link into the keyhole slot for each respective chain assembly prior to jack crank operation.

Having thus described embodiments of the present invention, it is the principal object herein to provide a jack assembly for raising of a propane cylinder gas tank.

One object of the present invention is a jack assembly for raising of a propane cylindrical gas tank which pivots the tank about one end of the feet of the tank.

Another object of the present invention is a jack for cylindrical tanks which provides for inspection, servicing, and painting of the tank in a safe and secure manner so as not to endanger the individual utilizing the jack, as well as working about the tank.

DESCRIPTION OF THE PREFERRED EMBODIMENTS

Figure 1:
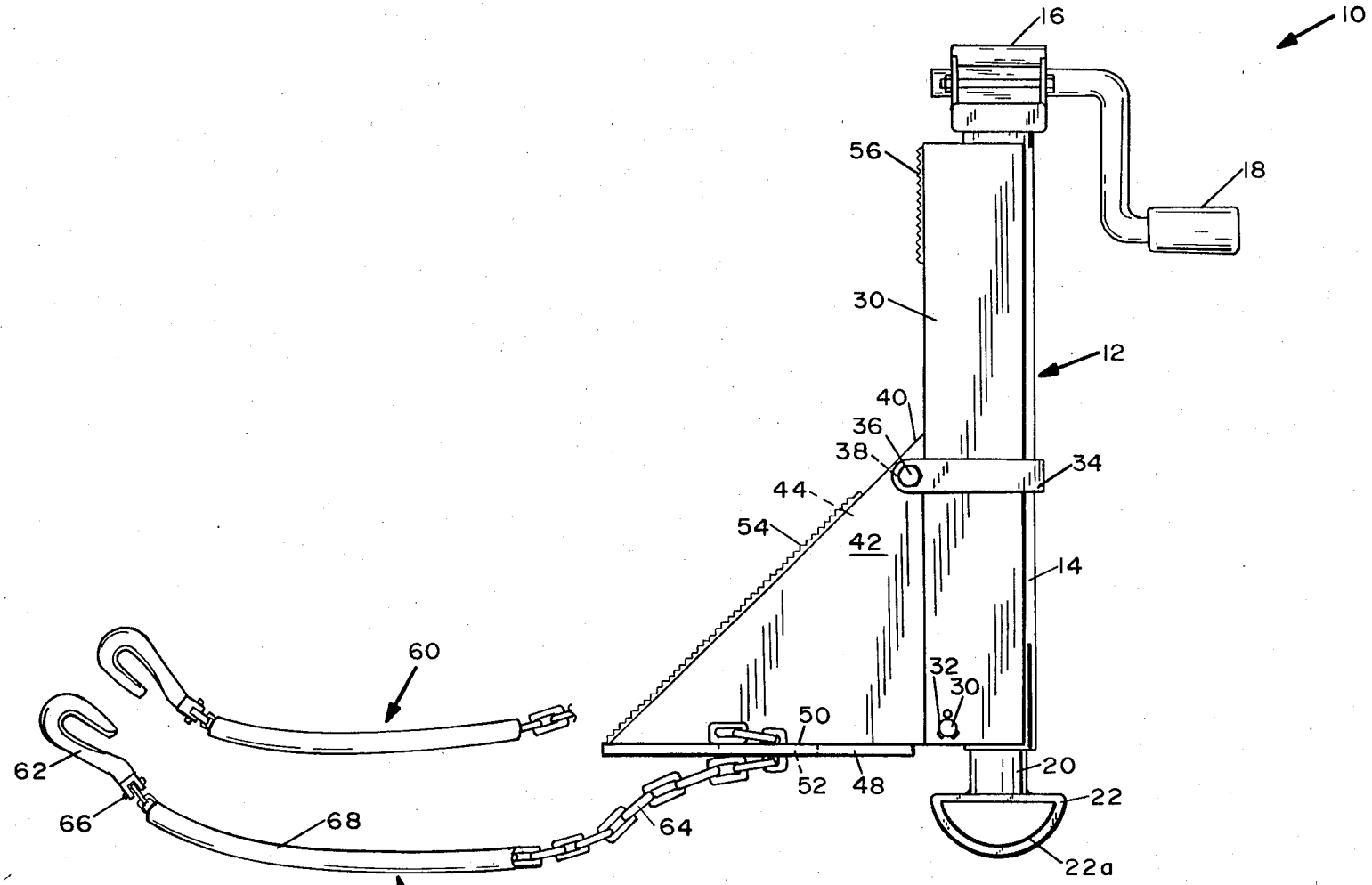
FIG. 1 illustrates a jack for a cylindrical tank, the present invention.
Figure 3:
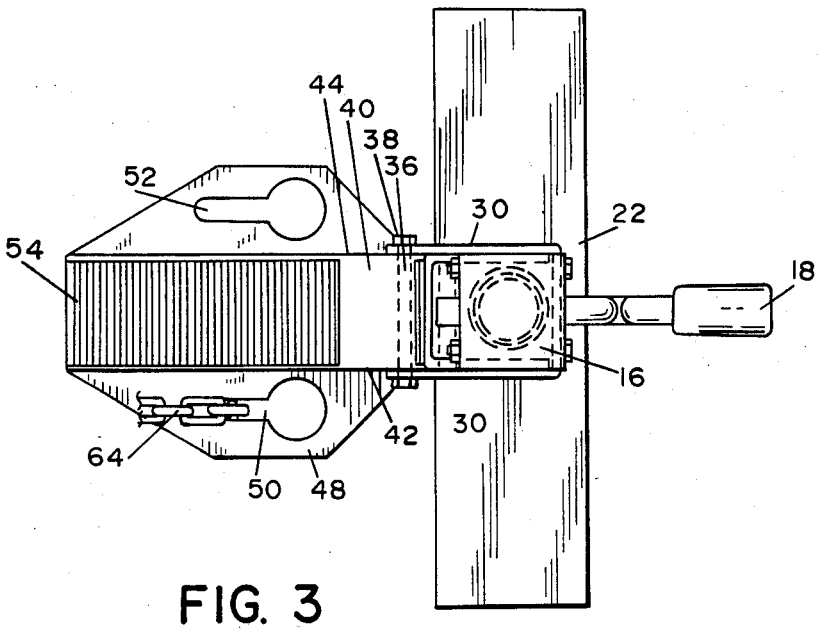
FIG. 3 illustrates a top view.
Figure 4:
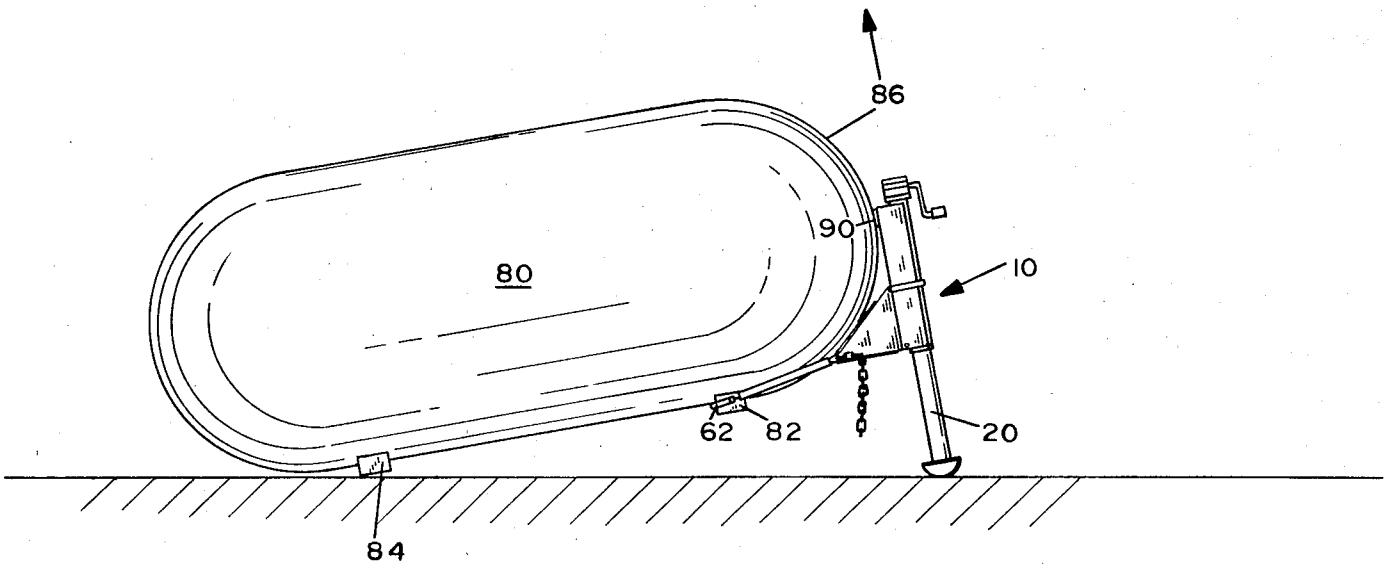
FIG. 4 illustrates the jack in operation about a cylindrical tank.

FIG. 1 illustrates a plan view of a jack 10 for a cylindrical tank, the present invention. A screw-type jack 12, as is commonly in the art, includes a jack housing tube 14 and a crank housing 16 supporting a jack crank handle 18. A jack actuator tube 20 extends downwardly from the jack housing 14 and includes an elongated jack foot 22 with a rounded bottom **22*a* for pivoting on the ground, as also illustrated in FIGS. 3 and 4. A bracket 24, as illustrated in FIG. 2, welds onto the lower portion of the jack housing 14, and includes a pivot tube 26 having a horizontal axis welded to a lower part of the bracket 24, as also illustrated in FIG. 2**.

The jack 10 includes a U-shaped channel member 30 for supporting and encompassing the screw-type jack 12. A pivot pin 31 fits through a pivot hole 32 and through the pivot tube 26 for retaining the jack housing tube 14 within the channel 30. A U-shaped retainer strap 34 encompasses the mid-portion of the jack housing tube 14 within the channel 30, and secures to a tank support 40 with a nut-and-bolt assembly 36 through a hole 38. The tank support 40 consists of plates 42 and 44 and weld to channel 30 as does a top supporting plate 46 extending at an angle with respect to the channel 30. A chain plate 48 secures to the bottom of the plates 42–46, such as by welding. The chain plate includes keyhole slots 50 and 52 of FIG. 3, as later described in detail. Rubber gripping pads 54 and 56 secure to members 46 and 30 respectively, such as by adhesive, and not only protects the tank's painted surface but also provides a secure gripping action.

Chain assemblies 58 and 60 are identical to each other. Chain assembly 58 includes a hook 62, a length of chain 64, a clevis pin 66 securing the hook 62 to one end of the chain 64. A chafe protector 68 is provided over a forward portion of the length of the chain for protecting the surface of the tank, etc.

Figure 2:
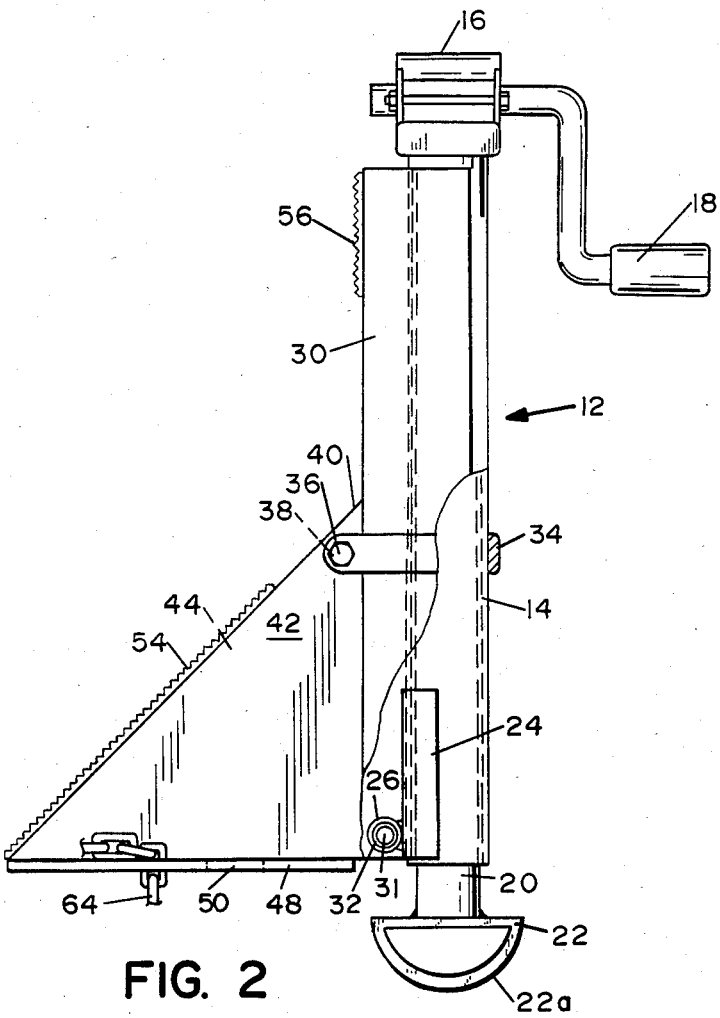
FIG. 2 illustrates a side view partially cut away.

FIG. 2 illustrates a partial cut away side view of jack 10, where all numerals correspond to those elements previously described. This particular illustration is the bracket 24 and secured pivot tube 26.

FIG. 3 illustrates a top view of the jack, where all numerals correspond to those elements previously described. Of particular illustration are the keyhole slots 50 and 52 for the insertion and locking of a chain link. Also, reference is made to the elongated jack foot 22. The rubber pads 54 and 56 are also illustrated.

MODE OF OPERATION

FIG. 4 illustrates the jack 10 in a raised position and secured about a cylindrical tank 80 including a pair of front feet 82 and a pair of rearward feet 84. The jack actuator tube 20 is illustrated in an extended position thereby raising the jack 10 upwardly, thereby carrying an end of the tank 86 upwardly. The tank is secured at four points, point 88 with respect to the rubber pad 54, point 90 with respect to the rubber pad 56, and both pairs of feet with respect to the hook 62 and an opposing hook which is not shown in the figure. This four-point placement provides for secure handling of the tank. The chain is held in place in the keyhole slots 50 and 52, based on a frictional engagement of the links with respect to the small diameter of the slot. As a safety precaution, the chain can be bolted about each of the keyhole slots with a nut-and-bolt assembly accordingly to provide for extra safety and security of the tank 80. While the specific screw-type jack 12 has been referenced in this disclosure with the crank handle 18, a hydraulic jack or any other like jack could be substituted for the screw-type jack. The specific jack is not limited to a screw-type jack, although the screw-type jack is advanced as being the most popular type of jack for this specific application.

We claim:

1. In combination, a jack with a tank support for elevating a cylindrical gas tank off the ground comprising:

a. jack assembly including a channel housing means, a crank handle rotatively supported at a top said channel housing means, a downwardly extending telescoping actuator tube means with an elongated foot secured within said channel housing means, and means actuating said actuator tube means in said channel housing means by rotation of said crank handle; and, b. tank support means secured to a lower portion of said channel housing means, said tank support means including a flat angled surface for resting against and supporting one end of the tank, keyhole slot means on both sides of said tank support means for accepting and engaging chain links, and chain assemblies including a hook end, clevis pin, and a length of chain including a chafing protector over a portion of said chain for securing the hook end to feet of the tank and the other end portion of each of said chains secured in said keyhole means of said tank support means whereby said angled surface engages against said tank, said chains tension the feet of the tank to said tank support means and said jack raises an end of the tank above the ground by downward telescoping movement of said actuator tube thereby providing for lifting and resetting of the tank for maintenance.

* * * * *